US006446825B1

(12) United States Patent
Godoy

(10) Patent No.: US 6,446,825 B1
(45) Date of Patent: Sep. 10, 2002

(54) CONTAINER OR ARTICULATED BOX, COLLAPSIBLE AND EXPANDABLE, TO BE UTILIZED FOR THE TRANSPORT OF FRUITS OR SIMILAR PRODUCTS

(75) Inventor: Sergio Goni Godoy, Santiago (CL)

(73) Assignee: Wenco S.A. (CL)

( * ) Notice: Subject to any disclaimer, the term of this patent is extended or adjusted under 35 U.S.C. 154(b) by 0 days.

(21) Appl. No.: 09/706,311

(22) Filed: Nov. 3, 2000

(30) Foreign Application Priority Data

Nov. 9, 1999 (CL) ..... 2579-99

(51) Int. Cl.[7] ..... B65D 7/00
(52) U.S. Cl. ..... 220/6; 220/1.5; 220/7
(58) Field of Search ..... 220/6, 7, 1.5

(56) References Cited

U.S. PATENT DOCUMENTS 3,360,180 A * 12/1967 Venturi ..... 220/6 X
4,044,910 A * 8/1977 Box ..... 220/6 X
4,062,467 A * 12/1977 Friedrich ..... 220/7
4,735,331 A * 4/1988 Keenan et al. ..... 220/6
6,015,056 A * 1/2000 Overholt et al. ..... 220/7 X
6,286,701 B1 * 9/2001 Umiker ..... 220/7 X

* cited by examiner

*Primary Examiner*—Steven Pollard
(74) *Attorney, Agent, or Firm*—Schnader Harrison Segal & Lewis LLP

(57) ABSTRACT

An articulated container, collapsible and expandable, to be used for the transport of fruits or similar products, formed by two front walls, two lateral walls, two upper tops and a floor or base floor, characterized in that said front walls present a grooved radius which commences in the penultimate horizontal rib from top to bottom. Thereafter a plurality of parts of truncated triangular sections are extended, similar to those that are present at the bottom or base floor. These being joined intermittently through their exterior facings by rectangular membranes extended transversally with respect to the floor or base floor; likewise, they are provided with hooking and piling parts as well as small latches, which commence at the upper and lower border of said front walls; the lateral walls of the interior surface are raised or expanded perpendicularly to the wall, forming the corners, prismatic bodies in the form of an "L"; the tops are joined with the lateral walls through intermittent membranes. This container is able to unfold and fold its different parts at the same time without disassembling it, which improves the speed in which it is assembled and occupies less space.

7 Claims, 11 Drawing Sheets

CONTAINER OR ARTICULATED BOX, COLLAPSIBLE AND EXPANDABLE, TO BE UTILIZED FOR THE TRANSPORT OF FRUITS OR SIMILAR PRODUCTS

DESCRIPTION

The present invention refers to a box or articulated container, collapsible and at the same time expandable, preferably to be used for the transportation of all types of fruits or similar foods, basically formed by a base body, four walls and two tops, which in their state of assembly form a prismatic body of rectangular style section, fabricated preferably of plastic.

At the present time the boxes or containers manufactured with plastic or other materials used in the transport or storage of foods or similar goods, in general present prismatic bodies with fixed or rigid structures and it is not possible to disassemble them, and to a lesser extend fold them or unfold them, thereby only presenting internal geometric holding characteristics.

Containers fabricated of carton are provided with folds that permit them on the one hand to unfold to form a prismatic body, yet not making possible their assembly by parts, nor their assembly among themselves. Likewise, they present the following inconveniences: due to the characteristics of the materials, only dry products may be packed therein; the resistance to weight is less than that of plastic containers; and they are more prone to tears and do not permit their pile up or placing one on top of the other.

In this regard, various systems or means have been invented for the construction of plastic containers or similar units with characteristics that permit the improvement of these structures, minimizing space usage for their transportation, lowering the costs of manufacture and the structuring of weight resistance.

One of these systems is described in [Chilean] Patent No. 38,228 which consists of a container box that is collapsible and which may be disassembled, formed by lateral polygonal panels with an articulated system, and a polygonal base susceptible or capable of being surrounded by the lateral panels and a top which is also polygonal, similar to that of the base, characterized in that the coupling device consists in a dovetail joint, said base being susceptible or capable of being surrounded by an articulated lateral panel, of a thickness which is noteworthy, wherein said articulated lateral panel is formed by as many rigid segments as sides which are present in the base polygon, the panel being articulated in areas of articulation that are located in varying edges, substantially parallel the ones with the others; said rigid segments, which are adjoining to said articulation areas, having reductions in their thickness in such measures that these reductions complement themselves in a sealing relationship with the reduction of the neighboring segment corresponding to the same articulation area. This articulated panel has, in one of its borders which is substantially transversal to the articulation areas, a coupling device which consists of a dovetail joint such that, between this coupling device and the base coupling device, a union and seal is produced between the base and the articulated lateral panel, said box being complemented in a sealing relationship with corresponding reductions formed on the opposite side to that of the base and the lateral ends of the articulated lateral panel preferably having self-adhesive union or joining devices.

Another system is mentioned in the [Chilean] patent of invention No. 37,743, devised to form a container with a dismounting system made principally of plastic components, utilized for the transportation of food items, especially fruits and vegetables. It has a structure that is totally disassembled, formed by injected component parts, characterized in that said structure is composed of two head boards and two lower longitudinal strips joined amongst themselves by means of a debilitated joint that functions as a hinge. Said head boards are built with various windows of reinforcing nerve structures or ribs in their external side and with fixating tongues that protrude on the upper parts of its sides, with internal and external holders, and fitting systems for the vertical piling up formed by tying elements at the upper and lower parts of the head board, as well as a system of horizontal ties between the piled up boxes formed by fitting "teeth" at the upper and lower parts. Lastly each headboard has protruding lower parts with internal outlying veined or ribbed structure, said box also having two upper strips provided with corresponding fitting openings (orifices), reinforcement vein or ribbed structure of difference thickness, open space areas, and a tying mechanism between the strips formed through a lateral protruding part and a corresponding lateral cavity. In addition, the box is formed with a flexible plastic film, tubular in shape, which is equipped with an intermediate reinforced weld. The box is also formed with a piece of corrugated carton that is hollowed in its surface and with lateral areas and their respective hollow portions, with areas of impression. The corrugated carton piece has a fold at the end of the lateral areas, where hollowed areas for fitting are provided.

Although these systems comply with the planned objectives, they present certain inconveniences, since none of the two invented systems allow for their structures to totally unfold or expand and it is only possible to disassemble them individually. Another inconvenience is that the costs of manufacture, since the assembly of these containers require the use of other elements or accessories.

DESCRIPTION OF THE INVENTION

The present invention offers a new articulated container, collapsible and expandable for storage and assembly, likewise utilized for packing and transporting different products. This is feasible because each one of the body parts are framing and joining parts, which allows the union of different body parts of the container without employing annexed elements. It likewise allows the joined body parts to rotate freely permitting the folding and unfolding of the container for storage and assembly, thus avoiding the disassembly of the box and minimizing space, and thereby being able to expand the box quickly in the desired moment.

The container has a maximum external capacity, as a result of its lateral and frontal walls being displaced outwardly in its central area, thereby providing for a larger volume of products in its cavity.

The advantages of the present container, due to their collapsing characteristics, makes it possible to minimize its volume, thereby allowing the transport of a larger quantity of units (structures) in a minimum amount of space, since upon piling up of these boxes a partial nesting effect is produced which allows the diminishing of their height.

Another advantage, compared with state of arts containers, is that the present invention does not require new accessories to assemble the container, which implies on the one hand speed on the assembly of a box and on the other hand lesser manufacturing costs and storage costs.

BRIEF DESCRIPTION OF THE FIGURES

In order to understand with more accuracy the characteristics of the container of this novel invention, the container shall be described, without limiting the invention, in accordance with the attached drawings that form an integral part of this invention wherein.

DETAILED DESCRIPTION OF THE INVENTION

Figure 1:
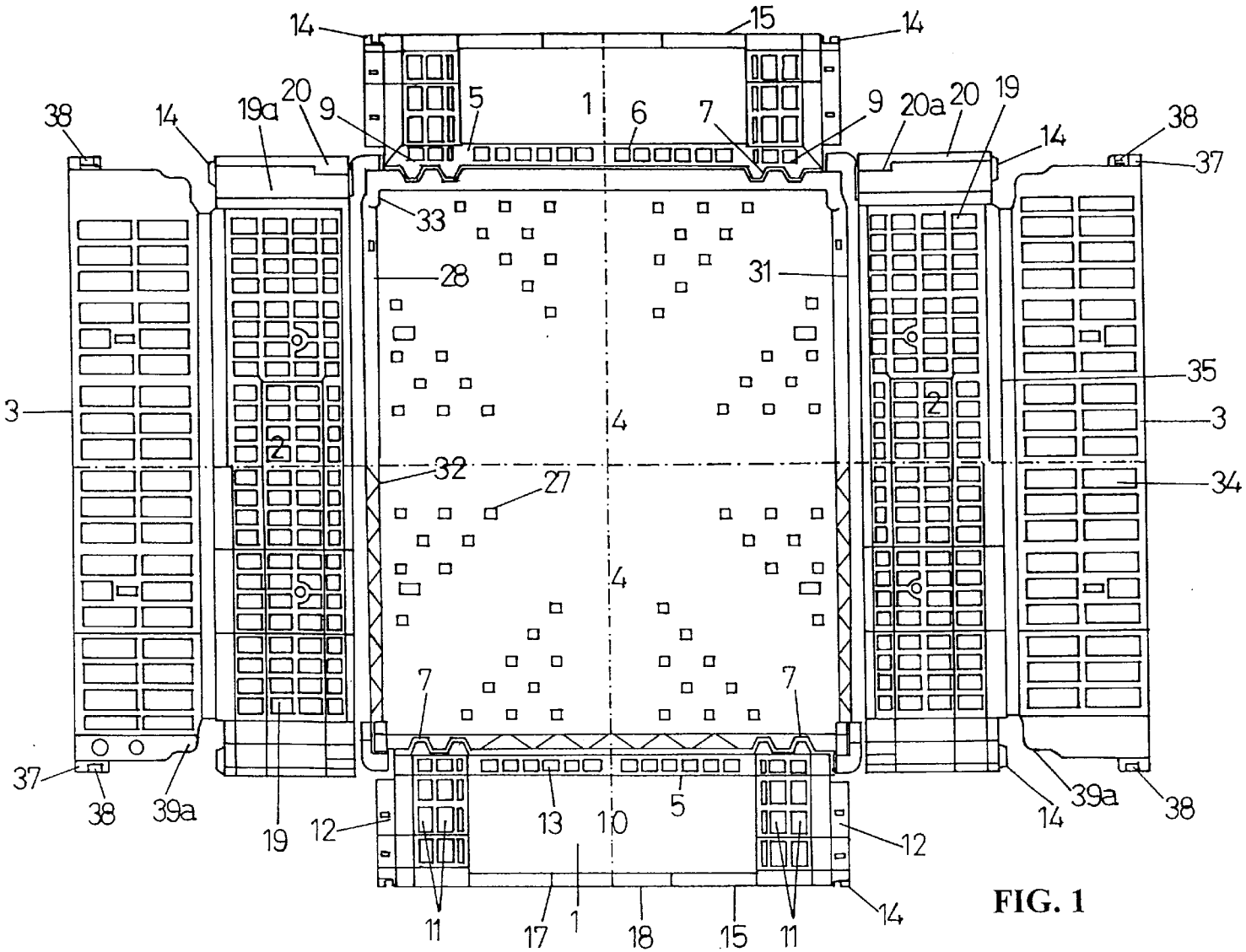
FIG. 1 shows an upper plan view of the lateral and frontal walls, the floor and upper doors of the container, in a totally unfolded or expanded position.

As can be seen in FIGS. 1 to 11, the invention basically consists of a structural group that permits the assembly of a container, with collapsing and expanding characteristics, used in the transport of foods or similar products, formed by two frontal walls (1), two lateral walls (2), two upper depressing tops (3) and a bottom or base floor (4).

At the lower ends of the frontal walls (1) where the slightly grooved convex area (5) ends, from where the penultimate horizontal rib or vein (6) commences, extended from top to bottom are bodies of truncated triangular sections (7) similar to those found at the bottom or base floor (4), joined among themselves in boundary at their exterior walls by vein structures or ribs (8).

At the intermediate areas of the truncated triangular sections (7) of both surfaces (bottom-frontal-wall) small membranes of rectangular surfaces (9) arise at the ends and a long membrane (9*a*) at the central area, stretched transversally with respect to the bottom of the base floor (4). These surfaces are flexible, thereby allowing that said frontal walls (1) to turn up to 180 degrees from their initial position. These types of intermittent membranes (9) (FIGS. 3 and 4) that extend along all the length and width of the base bottom (4) and the frontal walls (1) respectively, also allows for said walls to support and maintain themselves at the same level than that of the bottom of base floor (4) once the box is assembled (FIGS. 7, 8, 9 and 10), thereby avoiding the use of a double hinge, since a double hinge adheres mass to the object and therefor provides difficulty in its assembly.

Figure 3:
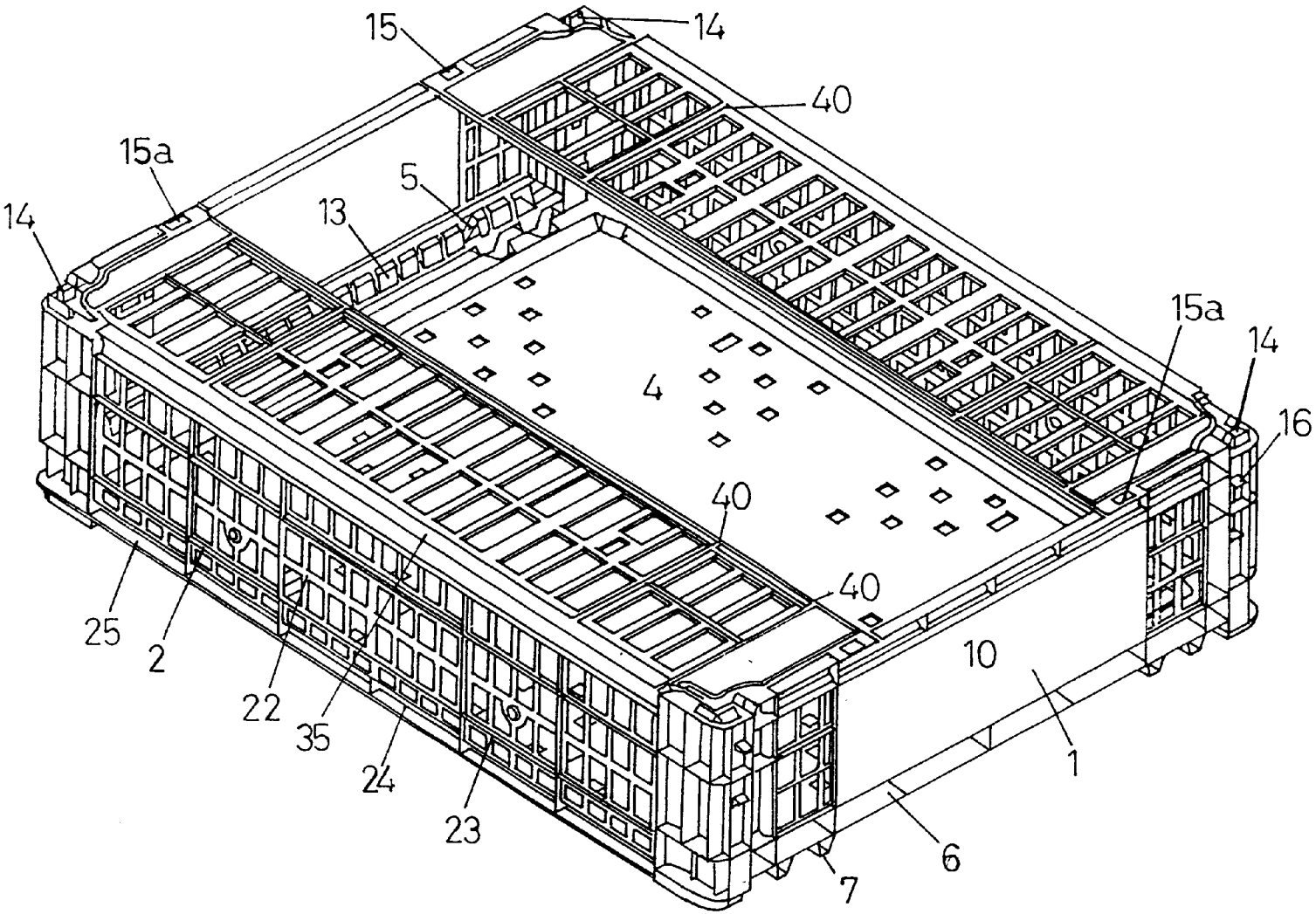
FIG. 3 shows a perspective view of the container already assembled in its final form.

The exterior faces of the frontal walls (1), present a smooth surface of oval rectangular shape (10) that overextends and remains at the same level of the exterior nerve or ribbed structures and that covers a large part of the central area of said walls (1), followed to the ends by grooved weaves with rectangular openings (11) oriented vertically and homogeneously distributed. Likewise at each end arise radiuses (12) vertically projected, that permit the largest thickness of said frontal walls (1) to be reached. In the interior lower area of said radius (5), projected horizontally thus encompassing the central surface, there are grooves of stretched rectangles (13) oriented vertically and which cross throughout its extension (FIG. 3).

At the corners of the upper borders of the frontal walls (1) and of the lateral walls (2) respectively, adhered are framing parts (14), that permit the piling up of other receptacles. There also exists a reduced section (15) with small external nerve or rib structures (15*a*) which permit the tops (3) to adhere themselves thereat.

Figure 11:
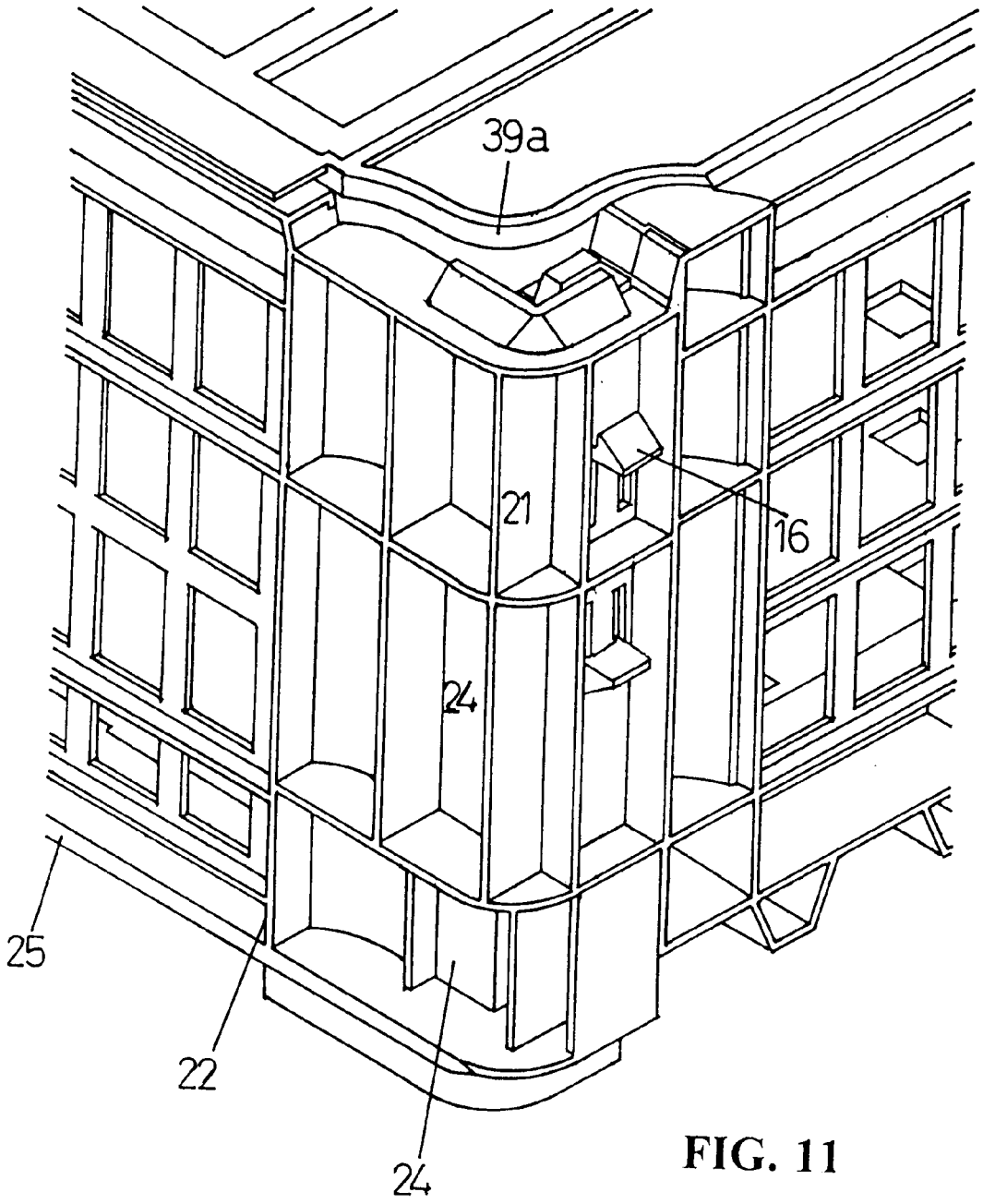
FIG. 11 shows a view of a corner of the container, with the detail of the hooking or latching part.

At the transversal ends of the exterior faces of the frontal walls (1), behind radius (12) and between the upper and lower vertical and horizontal groove, rectangular in shape, located are hooking or latching parts (16), which will permit the holding of the lateral walls (2) and frontal walls (1). These hooking or latching parts (16) are formed by rectangular elongated parts with a head of prismatic body of triangular section, which heads are oriented in opposing directions, so as to hold and latch these lateral walls (2). (FIG. 11.)

On the exterior faces of these frontal walls (1) also found are orthogonal stretches, formed by a series of vertical nerve structures or ribs (17) and horizontal nerve structures or ribs (18) that extend throughout the respective height and length of said walls (1).

Lateral walls (2) present in their interior faces smooth and straight surfaces at the middle areas, and a grooved stretch with openings (19) rectangular in the shape, vertically oriented, allowing for ventilation. The borders or edges of these areas are expanded with the assistance of a radius (19*a*), which is horizontally projected. Likewise the ends of these lateral walls (2) are expanded with the assistance of a vertically projected radius (19*b*).

At the center of the wall, a grooved rectangular area (19*a*) is projected, and at the lower border of this wall a step (10*d*) appears which opens outwardly.

Figure 4:
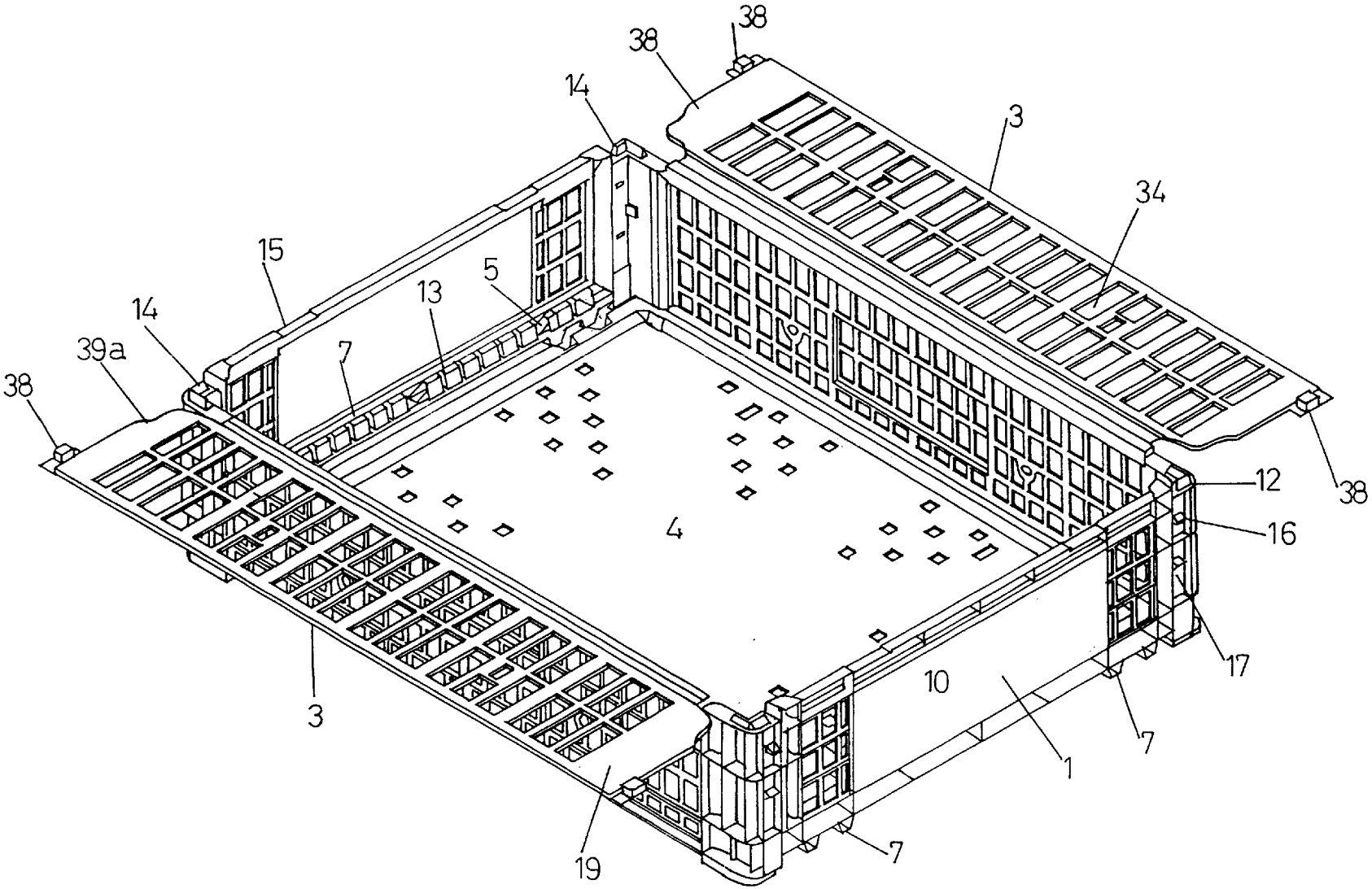
FIG. 4 shows a perspective view of the container already assembled, with the tops in an open position.
Figure 5:
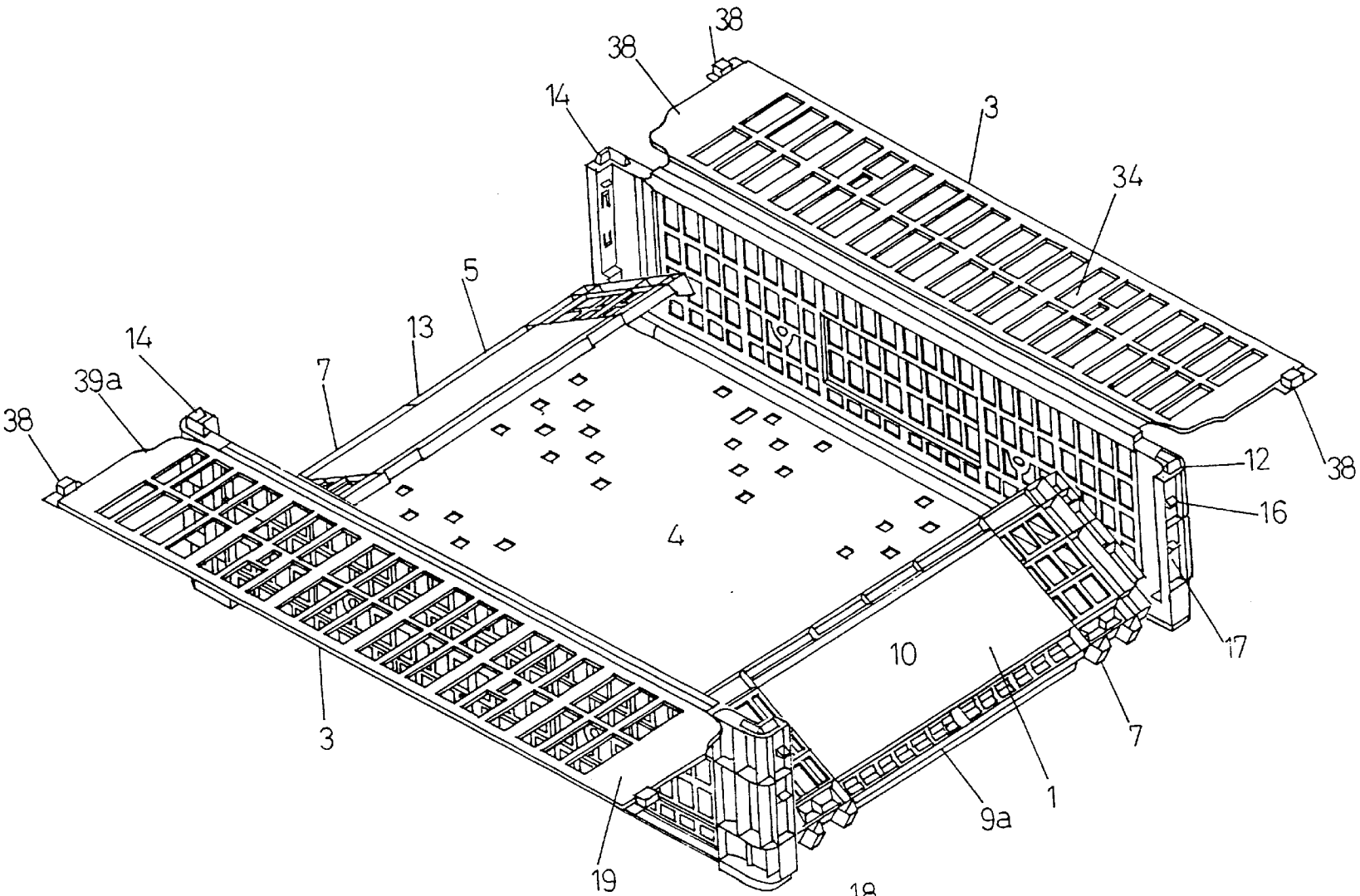
FIG. 5 shows a perspective view of the container, in a sequence of folding and assembly.

The ends of the lateral walls (2), at the interior surfaces, are raised perpendicularly to the wall, expanding at its lower ends, forming the corners of the walls in an "L" shape (20). From these perpendicular surfaces at their lower ends, small parallelepiped parts (20") are formed, found very near the lower borders of said walls. Rectangular shaped openings (21) of FIG. 4 are also found, stretching horizontally, which allow for hooking or latching parts (16) found on the frontal walls (1), at the moment of assembly (FIGS. 1, 3 and 11).

Figure 6:
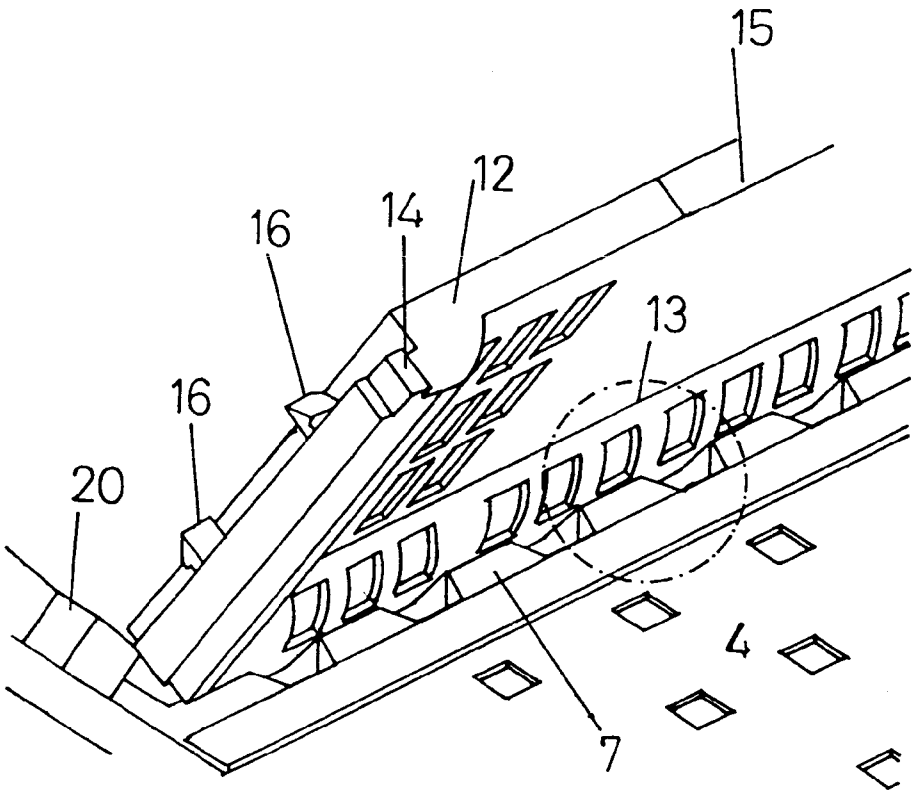
FIG. 6 shows a view of one of the lateral walls with the floor and a detail of the union between them.
Figure 6:
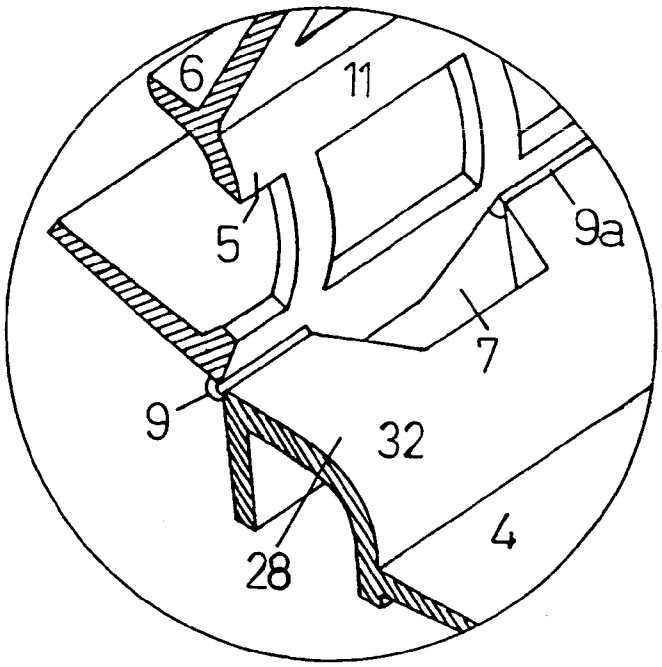
Figure 7:
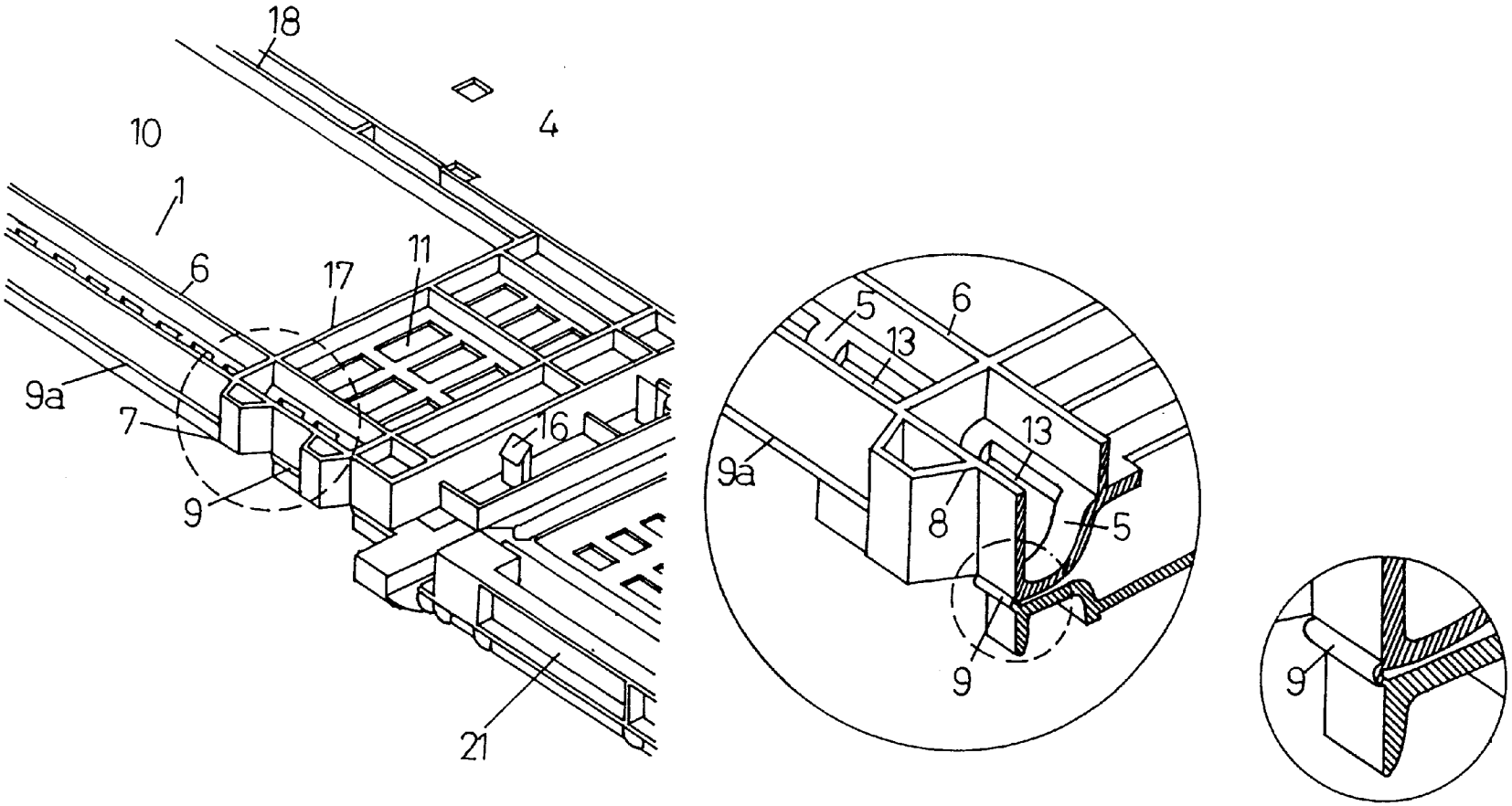
FIG. 7 shows a partial view between the lateral wall, the floor and the frontal wall, along with a detail showing the joining system.

At the exterior faces of said lateral walls (2), also found are orthogonal weaves formed at each wall (1), a series of vertical vein structures or ribs (22) and horizontal nerve structures or ribs (23) that extend through the height and length, respectively, built around a plurality of dissimilar rectangular sections (24) (FIGS. 7, 8, 9 and 10). The lower borders of the lateral walls (2), below the step, are joined with the border of the base floor (4) through a continuous surface or membrane of flexible material (25) that covers the length of the border of said walls, allowing them their ability to expand and a maximum 270 degrees turn (FIG. 6).

The container has hooking or latching parts of circular, semi spherical heads (25*a*) oriented or facing outwardly, that overextend the smooth surface of the wall and are found at the same level than that of the exterior nerve structures. These parts allow the setting of both the lateral walls (2) to the bottom at the instance of transfer of the box in a folded position (FIG. 9) as well as the lateral walls (2) with the tops (3) at the instance in which the container is filled with its content.

Figure 2:
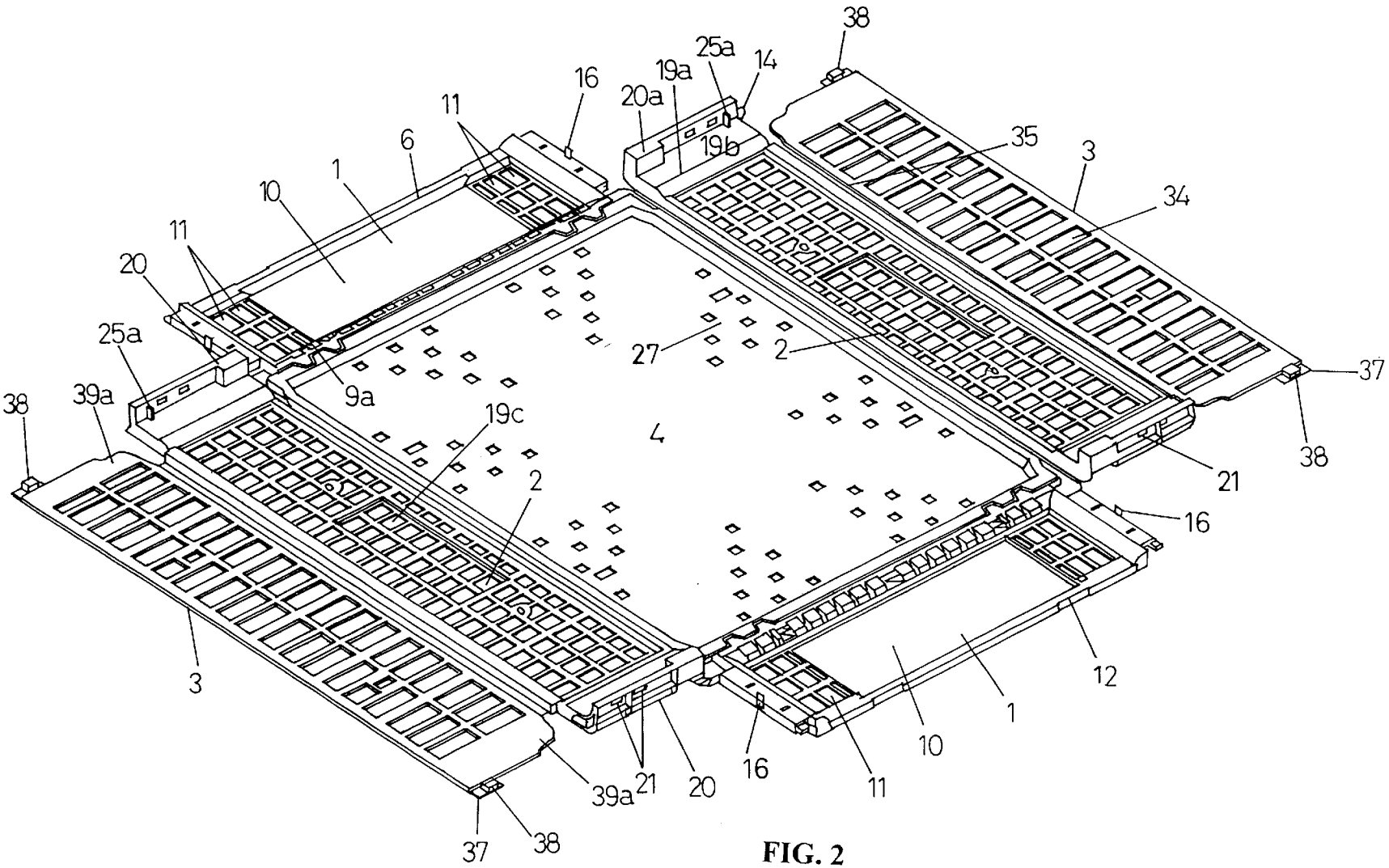
FIG. 2 shows a perspective view of the container, with all its walls unfolded.
Figure 8:
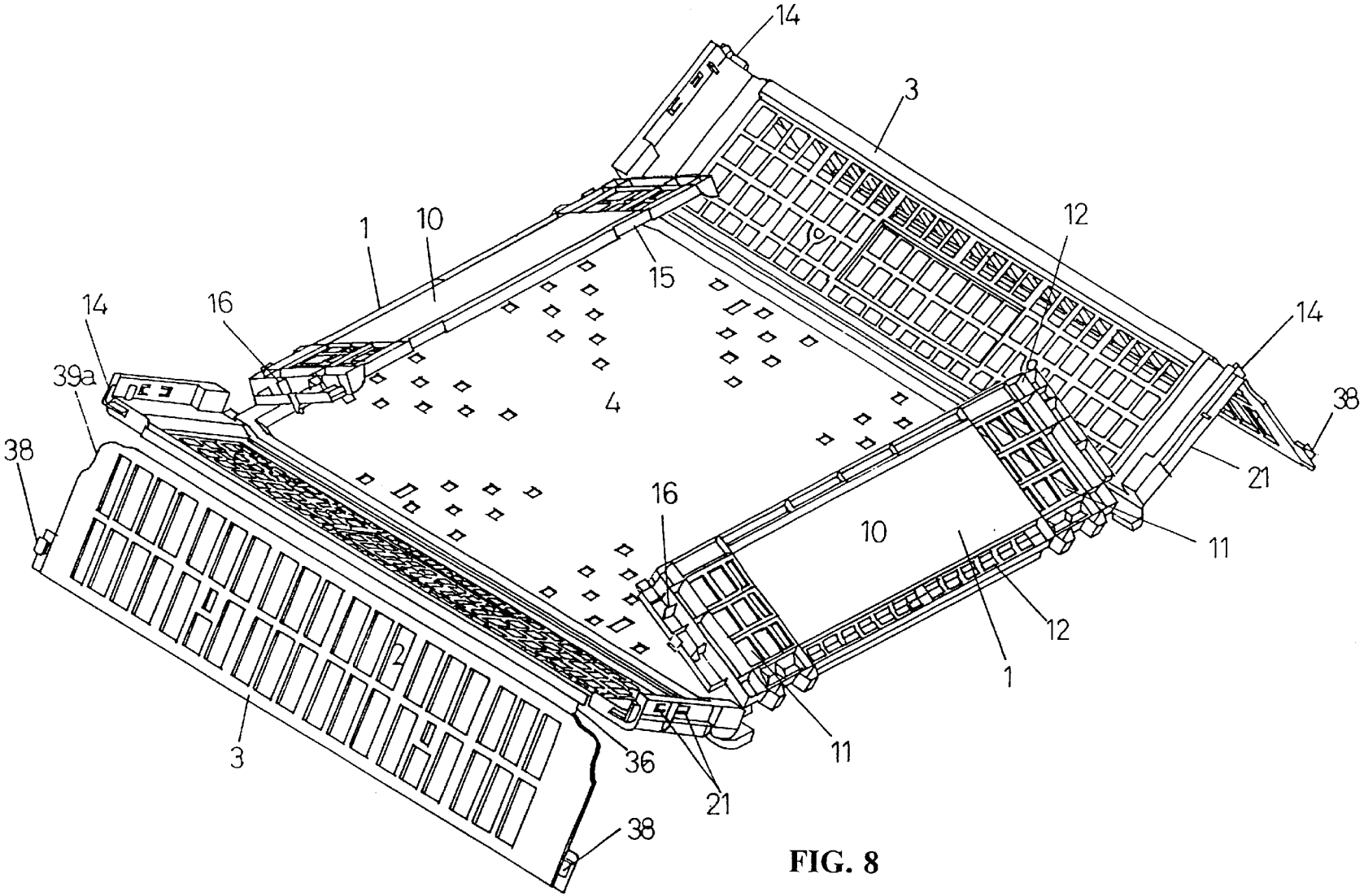
FIG. 8 shows a view of the container in a sequence of deployment of all its parts.
Figure 9:
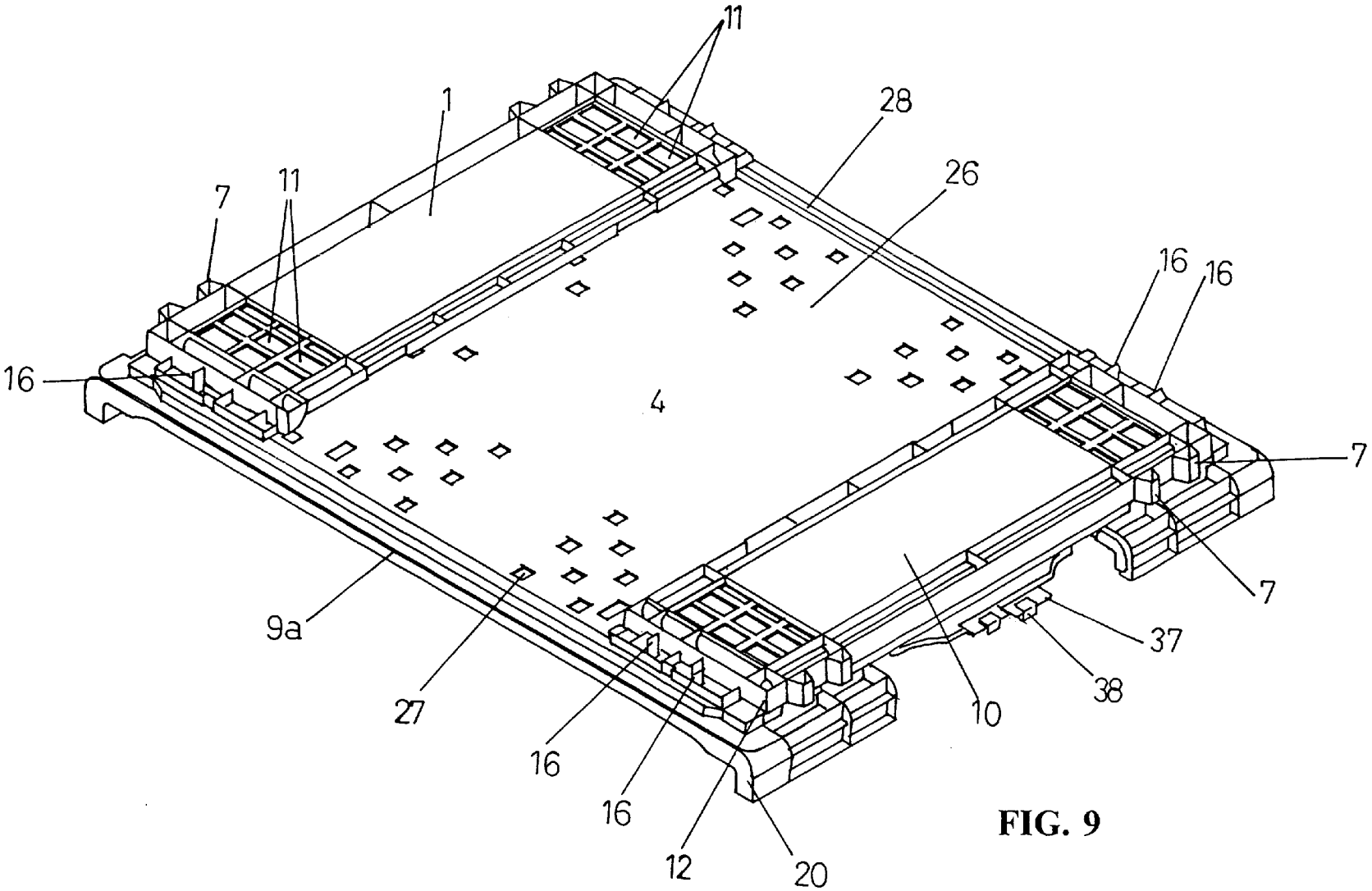
FIG. 9 shows a perspective view of the container, totally folded.
Figure 10:
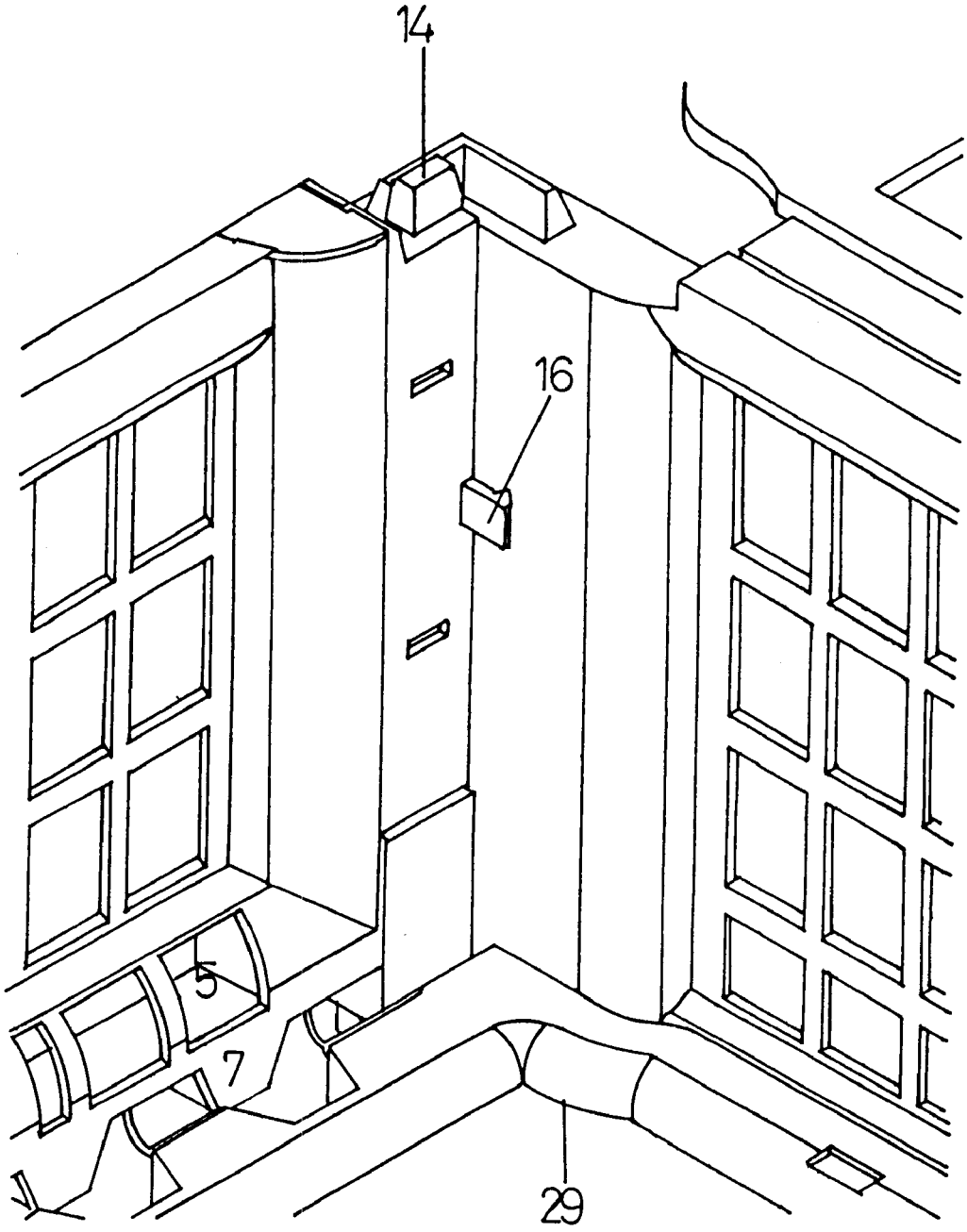
FIG. 10 show a view of the interior corner of the container folded and assembled, with a detail of the supporting corners, walls and bottom.

The container's base or plan floor (4) presents a surface of rectangular longitudinal section of an interior wall, smooth and straight (26), with a plurality of square grooves (27), grouped triangularly, homogeneously distributed throughout the length and width of the floor perimeter 4 (FIGS. 2 and 3). This surface is also framed at its longitudinal sides by a hollowed step (28) which opens outwardly, and which extends throughout the length of the central surface, with a semicircular face (29) which looks inwardly and another perpendicular face (30) which looks outwardly, followed by a smooth and straight surface (31) that borders this step from the outside and which acts as a support for lateral walls (1 and 2) at the moment of assembly (FIGS. 2, 3 and 8).

At the transversal ends of the central surface there appears a step (32), serrated and hollowed in shape (FIGS. 2 and 4), which opens outwardly, wider than the prior one but of the same height and with an interior semicircular face (33). The exterior base of the floor or bottom (4) is smooth and straight with nerve structures or ribs that border the corners of said base floor or bottom (4).

The tops (3) present a body of little thickness and rectangular in shape, with ends that follow the shape that forms at the corners, i.e., the walls once joined and assembled (FIG. 3). Likewise they present openings rectangular in shape (34), transversally larger than all those wall openings (frontal, lateral and floor), which extend themselves throughout the surface of the tops. These tops (3) also present a smooth rectangular surface (35) of lesser thickness and length, which is found throughout the lower longitudinal border and which are joined intermittently at the borders of the central area of the lateral walls (2), by membranes of little thickness and length (36) that act as a type of hinge, allowing them to turn at a maximum radius of 270°. At the ends of the tops (3) extended are rectangular smooth surfaces (37) which have a rectangular groove central from where the hooking or latching part commences perpendicularly in the shape of an "L" (38) and which have at its interior end a rolling element (36) that acts to latch or hook at the upper border of the frontal walls (1). At the lower corners or vertex of said tops (3) and at each side, found are circular cuts (39*a*).

The exterior faces of the tops (3) are provided with low vein or rib structures (40) that are located along the lower longitudinal border and at the ends, transversally staggered.

At the corners of the assembled container, converged among them are four different parts that together form a totality, a unitary body of frontal walls (1), lateral walls (2), tops (3) and a bottom (4).

Once the container is assembled, the corners behave in the following manner.

The bottom at its reinforced corner with the parallelepiped cavity that holds the hooking or latching part (16), receives upon it the parallelepiped cavity appendix (20) of the lateral walls (2), and upon this appendix is situated the reinforced end with nerve structures or ribs of the frontal walls (1). This cohesion remains rigidly sustained with the latching parts (16) that arise at each one of the frontal walls (1), crossing the interior face of the lateral walls (2) through the rectangular openings which facilitate its standing, preventing the walls from taking their initial horizontal shape.

What is claimed is:

1. An articulated container, collapsible and expandable, utilized for the transportation of fruits or similar food products, formed by two frontal walls, two lateral walls, two upper tops and a base wherein said frontal walls, lateral walls, upper tops and base are all joined together, and wherein said frontal walls include a series of horizontal ribs; a curved section which begins at a penultimate horizontal rib (from top to bottom), a plurality of truncated triangular sections situated at the end of each said frontal wall proximate said base, wherein said frontal walls are each connected to said base by a series of hinges between said truncated triangular sections, and said lateral walls are connected to said base by a series of hinges said frontal walls including hooking or latching means for securing said frontal walls to said lateral walls, said hooking or latching means located proximate upper and lower edges of said frontal walls; said tops are hingedly connected to said lateral walls, and said frontal and lateral walls and tops are adapted to be folded from a first, storage position, to a second, working position, and wherein, when in said working position, said frontal walls include means securing said frontal walls to said tops, and said lateral walls, frontal walls, base and tops define a cargo-carrying volume therebetween when said lateral walls, frontal walls and tops are in said working position.

2. An articulated container in accordance with claim 1, wherein the hinges are of a flexible material, thereby permitting the frontal walls to rotate 180° and permitting the lateral walls and tops to rotate 270° and wherein the hinges extend along the length and width of the bottom of the base, and wherein the frontal and lateral walls are level with the bottom of the base when the frontal and lateral walls are in a working position, thereby eliminating the need for a double hinge.

3. An articulated container in accordance with claim 1, wherein the securing means is adapted to secure the walls in a rigid and firm position.

4. An articulated container in accordance with claim 1 wherein the truncated triangular sections are located at all corners of the frontal and lateral walls.

5. An articulated container in accordance with claim 1, wherein said securing means comprises hooks in said frontal walls and receiving slots in said lateral walls.

6. An articulated container, in accordance with claim 1, wherein said base floor includes a raised border around its edge having a curved section at the point of attachment to the base floor, wherein the border includes, towards the exterior thereof, a smooth surface of lesser thickness than that of the floor along its entire length.

7. An articulated container, in accordance with claim 1, wherein said walls form openings at the ends which permit adjustment of the latching or hooking parts on the frontal walls.

* * * * *

UNITED STATES PATENT AND TRADEMARK OFFICE

CERTIFICATE OF CORRECTION

PATENT NO. : 6,446,825 B1 
DATED : September 10, 2002
INVENTOR(S) : Sergio Goni Godoy et al.

It is certified that error appears in the above-identified patent and that said Letters Patent is hereby corrected as shown below:

Column 4,
Line 46, please change "(20")" to -- ($20^3$) --

Signed and Sealed this

Eighteenth Day of March, 2003

JAMES E. ROGAN
*Director of the United States Patent and Trademark Office*